US005678257A

United States Patent [19]

Morcate et al.

[11] Patent Number: 5,678,257

[45] Date of Patent: Oct. 21, 1997

[54] PORTABLE, SELF-CONTAINED BATHING APPARATUS FOR INCAPACITATED/ BEDRIDDEN INDIVIDUALS

[76] Inventors: Joseph Morcate, 905 W. 26 St., Apt. 115, Lynn Haven, Fla. 32444; Christy Elaine Jones, 3314 Avon Rd., Panama City, Fla. 32405

[21] Appl. No.: 666,097

[22] Filed: Jul. 1, 1996

[51] Int. Cl.[6] ..... A47K 3/06; A47K 3/062

[52] U.S. Cl. ..... 4/585; 4/540; 4/555; 4/560.1

[58] Field of Search ..... 4/585, 540, 555, 4/560.1, 564.1, 565.1, 566.1, 586, 587, 604, 611; 5/606, 620

[56] References Cited

U.S. PATENT DOCUMENTS

| | | | |
|---|---|---|---|
| 1,451,437 | 4/1923 | Bernier | 4/587 |
| 2,860,349 | 11/1958 | Blomqvist | 4/540 |
| 3,334,360 | 8/1967 | Hoxeng et al. | 4/585 |
| 3,469,266 | 9/1969 | Hyde | 4/560.1 |
| 3,800,336 | 4/1974 | Hoxeng | 4/587 |
| 4,305,165 | 12/1981 | Wall, Jr. | 4/549 |
| 4,577,354 | 3/1986 | Stratton | 4/585 |
| 4,713,850 | 12/1987 | Flaherty et al. | 4/564.1 |
| 5,285,539 | 2/1994 | Anderson et al. | 4/573 |

*Primary Examiner*—Henry J. Recla
*Assistant Examiner*—Charles R. Eloshway
*Attorney, Agent, or Firm*—Carnes, Cona and Dixon

[57] ABSTRACT

A portable bathing apparatus that wheels to the patient's bed and then elevates to be even with the bed. It is equipped with a disposable tub unit, which may be sterilized for reuse and which raises and lowers. The apparatus is also provided with safety rails, an elevating back rest, a hand held shower unit, and a self-contained holding tank for used bath water. In addition, the portable bathing apparatus may be attached to a water source at the site of use, via a hose with an adapter the can be removably secured onto a standard faucet. The portable bathtub apparatus provides a satisfactory method of cleansing patients.

16 Claims, 5 Drawing Sheets

PORTABLE, SELF-CONTAINED BATHING APPARATUS FOR INCAPACITATED/ BEDRIDDEN INDIVIDUALS

BACKGROUND OF THE INVENTION

1. Field of the Invention

The present invention relates generally to a portable bathing apparatus for bedridden patients and more particularly to a portable, self-contained bathing apparatus for bedridden individuals which practically and conveniently meet or exceed the hygienic needs of an individual confined to a bed while requiring minimal or no support personnel for the bathing process.

2. Description of the Prior Art

For many years patients, health care givers in hospitals, nursing homes, and other health care facilities have faced the dilemma of properly cleaning and bathing incapacitated and bedridden patients. The traditional method for bathing patients has been sponge baths. Sponge bathing does provide a means of cleaning/bathing a patient, but it has the following limitations: (a) The patient does not "feel clean"; (b) it is often performed under less than sterile conditions; (c) it is usually messy and difficult to perform; (d) it must be accomplished in the bed or area of restriction with little to no privacy; and (e) it frequently requires two or more support personnel. Consequently, several devices have been designed to replace the traditional sponge bath.

One such a device is disclosed in U.S. Pat. No. 5,285,539 issued to Anderson et al. This device includes a flexible tub unit mounted on a wheeled frame. The tub unit contains a mesh sheet which lifts to support the patient. A shower head is used to wash the patient and is attached to a faucet to provide water. A holding tank for used water is also disclosed. The disadvantage of this device is that the mesh support system for the patient is not stable and rigid. Due to the instability of the mesh material, the possibility exists that the mesh material may rip or tear during use, inherently endangering the patient and/or support staff.

Another device is disclosed in U.S. Pat. No. 4,305,165 issued to Wall, wherein Wall discloses a rigid basin with a non-porous disposable lining that is mounted on a wheeled frame. A holding tank for used water is disclosed. Water is provided by a self contained system that uses a pumping system to circulate the water. The self contained system adds unnecessary costs and weight to the system. Such a device would be burdensome to use.

Still another device is disclosed in U.S. Pat. No. 4,577,354 issued to Stratton which discloses a flexible tub that includes side walls that can be raised or lowered. This will provide for a device which can act as tub when the side walls are in a raised position or act as a patient cart when the side walls are in a closed position. This apparatus disclosed in Stratton, though efficient in transporting patients, does suffer drawbacks when utilized as a bathing apparatus. Stratton does not disclose a means of conveniently and efficiently providing water into the tub area. Further, Stratton does not disclose a holding tank for relocating the water after use. Hence, for a patient to be bathed in Stratton's device, he must first be transported to a bathing area where the water can be placed in the tub and then be relocated from the tub. This device provides for at least two staff members to transport the patient from one location to the second location. This means of transportation is time consuming, cumbersome and labor intensive for the staff members and patient.

Another device is disclosed in U.S. Pat. No. 4,713,850 issued to Flaherty et al. This apparatus consists of a support platform mounted on a support frame. A circumferential rail with a sheet attached to the railed is located on the frame. This circumferential rail is movable between a position parallel to the support platform or to a position above the support platform to define the tub. A holding tank is disclosed which rolls along side the frame. The use of the holding tank rolling along the side of the frame provides for an apparatus that is difficult and awkward to manage and maneuver.

None of the previous efforts provide the combination of benefits that the present invention furnishes; i.e., a device that will meet or exceed the hygienic needs of an incapacitated or bedridden patient by providing a disposable tub liner, a shower curtain, and fresh, running water via a hose that is attached to a standard faucet. In addition, the present invention includes a rigid back support that will increase comfort and stability for the patient. Safety rails are also provide and can be raised to render security and additional stability. Prior techniques do not suggest the present combination of component elements as disclosed and claimed herein. The present invention achieves its intended purposes, objectives and advantages over the prior art and is of simplified design, has a low initial cost, low operating cost, and is easy to install and maintain.

SUMMARY OF THE INVENTION

The present invention provides for a portable, self-contained, bathing apparatus for incapacitated/bedridden patients. This apparatus will practically and conveniently meet or exceed the hygienic needs of an individual confined to a bed yet requires minimal or no support personnel for the bathing process.

The portable, self-contained bathing apparatus of the present invention includes a frame that has two horizontal safety rails that may be raised or lowered and locked into a secured position.

This bathing apparatus also includes four vertical telescoping poles that can be raised and locked into place. Secured to the poles via a securing means is a durable, waterproof, and collapsible material. Once the poles are telescoped and locked in an upright position, the material and poles form a portable tub or basin. This durable, impenetrable material is patterned to be temporarily secured to the telescoping poles, thereby providing for the material to be disposed of and replaced after each use or be optionally sterilized for reuse. Once the poles are lifted and locked in a vertical position, the attached material forms a portable tub or basin and also provides some privacy for the patient.

A hose with a shower head at one end and an adapter for receiving a conventional water faucet located at the opposite end is provided with the portable, self-contained bath device. This hose will permit for water to be transported to the portable tub or basin. During the bathing process, the water is relocated into a self-contained holding tank that is located on the frame under the portable tub.

Accordingly, it is the object of the present invention to provide for a portable, self-contained bathing apparatus for bedridden patients that will provide an adequate, safe, efficient, hygienic and easy-to-use means of bathing patients.

Another object of the present invention is to provide a portable, self-contained bathing apparatus which will over come the deficiencies, drawbacks and shortcomings of prior bathing apparatuses and methods thereof.

Yet another object of the present invention is to provide a portable, self-contained bathing apparatus which will provide some patient privacy.

Still a further object of the present invention is to provide for a portable, self-contained bathing apparatus for incapacitated/bedridden patients that will render a means of collecting and retaining used bathing water for proper disposal; and it will provide an apparatus which includes a basin area that is clean and sterile after each use in order to prevent the occurrence of an unsanitary/unsterial condition and apparatus.

A final object of the present invention, is to provide an apparatus in accordance with the preceding objects which will conform to conventional forms of manufacture, be simple to construct and easy to use so as to provide an apparatus that would be economically feasible, long lasting and relatively trouble free in operation.

Although there have been many inventions related to portable bathing apparatuses, none of the inventions have become sufficiently compact, low cost, and reliable enough to be commonly used. The present invention meets the requirements of simplified design, compact size, low initial cost, low operating cost, easy installation, low maintenance, little to no training, and minimum personnel to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
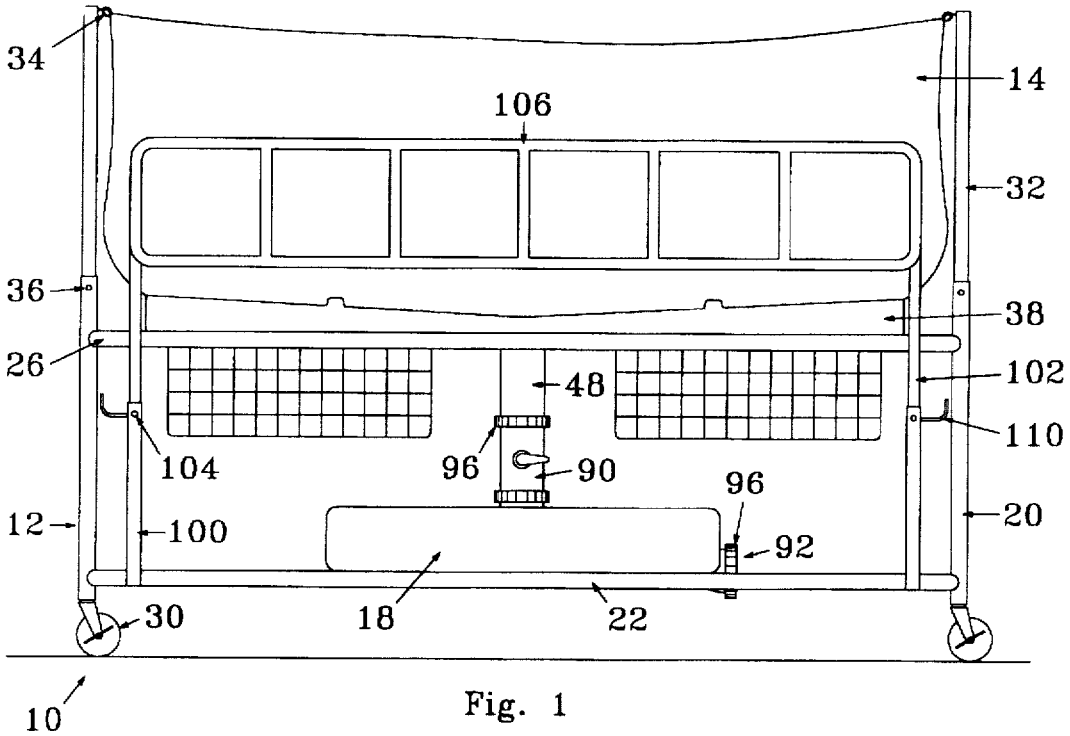
FIG. 1 is a side view of the portable bathing apparatus of the present invention with the safety rails and tub unit raised.

As illustrated throughout the various views of the drawings (FIGS. 1–7), the portable bathtub apparatus 10 comprises a support frame structure 12 that is adapted to receive and maintain a basin means 14. This basin means 14 is supported by the frame structure 12 and is adapted to receive a durable, waterproof, collapsible material 16 for providing the basin means and material to define a bathtub-like enclosure. This bathtub-like enclosure is used for receiving and supporting incapacitated/bedridden patients for purposes of showering and/or bathing. A holding tank 18 is supported on the support frame structure 12 for retaining the used water and for enabling disposal elsewhere.

The support frame structure 12 includes four vertical frame members 20 connected together, at its lower end, via lower horizontal braces 22 and lower traverse braces 24. The vertical frame members 20 are also connected together, centrally, via upper horizontal braces 26 and upper transverse braces 28. The vertical frame members 20, lower and central horizontal braces, and lower and central traverse braces form a rectangular structure that is adapted to form a portable, self contained bathing apparatus.

Located at the lower end of each vertical support member 20 are wheels 30, each including a brake. These wheel are used to provide easy mobility of the bathing apparatus 10.

Extending upwardly from each vertical support member 20 are telescoping vertical members 32. These telescoping vertical members 32 are adapted to be received in the vertical frame member 20. Located on the upper end of the telescoping vertical member 32 are receiving means 34. These receiving means 34, illustrated as eyelets, are adapted to receive and maintain the collapsible material 16. Accordingly, the receiving means 34 maintains the collapsible material 16. The basin means 14 is defined once the telescoping members 32 are in a raised and upright position (as illustrated in FIG. 1). A locking means 36 is provided for locking the telescoping member 32 in an upright and secured position.

The locking means 36 can be any conventional locking means. One such locking means which has proven to work successfully is to provide each telescoping member with a spring loaded pin or button. Each vertical support member 20 is provided with an aperture for receiving the spring loaded pin or button. Accordingly, the pin or button emerges from the aperture to render the members to be in a locked an upright position.

Adapted to be removably secured to the central horizontal braces 26 and traverse braces 28 is a first support pad 38. This first support pad 38 includes an upper surface 40 and a lower surface 42. The lower surface 42 includes grooves 44 which are adapted to engage and lock to the central traverse braces 28. The grooves 44 and central traverse braces act as interlocking members for locking the support pad 38 to the support frame structure 12. The basin means 14 will be contacting the upper surface of the support pad, thereby providing the first support pad to be located exteriorly from the basin means.

Extending from the upper surface 40 to the lower surface 42 of the support pad 38 is a through hole 46. This through hole 46 is adapted to receive tubing 48. Tubing 48 is used to guide and transport used bath water from the basin means 14 to the holding tank 18.

The upper surface 40 of the support pad 38 further includes interlocking ridges 50. These interlocking ridges 50 are adapted to engage and lock to receiving grooves 54 located on a lower surface 56 of a second support pad 52. This second support pad 52 is adapted to be located within the basin means 14 to provide for the basin means 14 to be sandwich between the first and second support pad 38 and 42, respectively.

Centrally located and extending through the second support pad 52 is an aperture 58. This aperture 58 is aligned with the through hole 46 of the first support pad 38, so as to enable efficient fluid flow from the basin means to the holding tank 18. Also centrally located on an upper surface of the second support pad 52 is a transverse channel 60.

Located on the upper surface of the second support pad 52 is a patient support pad 64. This patient support pad 64 is adapted to receive and support a patient. The patient support pad 64 includes a first side 66*a*, a second side 66*b*, and a center portion 66*c* located therebetween. This center portion 66*c* is received and maintained in the channel 60 of the second support pad 52. The first and second side, 66*a* and 66*b*, are adapted to be raised or lowered via a lifting and adjusting means 62 so as to provide back support for the user. The center portion 66*c* will receive the ends of the first and second portion when they are raised, and as such, this transverse channel will adequately sustain the end of the first or second side. Though not illustrated, this pad includes an aperture for properly draining the basin means.

The lifting and adjusting means 62 comprises braces 72 secured to the lower surface of the first side 66*a* and second side 66*b* of the patient support pad 64. These braces 72 are adapted to receive locking bar members 76. These locking bar members 76 are secured to pivot bar 74 via rods 80. The pivot bar 74 is pivotally secured to the second support pad 52. The pivot bar 74 includes opposite ends 74*a* which are received in openings 75 located in the second support pad 52. Accordingly, this will provide for the pivot bar 74 to pivot freely about openings 75.

The locking bar members 76, pivot bars 74, and rods 80 are housed within cavities 78 located in the second support pad 52 when the lifting and adjusting means is not in use. This will provide for the lifting and adjusting means to be flush with the upper surface of the second support pad 52.

The collapsible material 16, which forms the basin means 14 is designed to have an opened top 82 for receiving the patient, an enclosed bottom, and vertical side walls 84. This will provide for a tub-like structure. Secured to the upper edge of the side walls 84 are cooperating receiving means 34*b*. These cooperating receiving means are adapted to be secured to the first receiving means 34*a*, thereby providing for the side walls 84 of the basin means 14 to be in a lifted and usable position when the telescopic member 32 is in an extended position (see FIGS. 1, 3, 5 and 6). The side walls will be in a collapsed position when the telescopic member 32 is in a received and stored position within the vertical frame member 20 (see FIG. 2). The sidewalks are designed and configured to enclose the user, so as to provide a device 10 which will offer not only adequate cleaning possibilities, but also privacy.

The second receiving means can be hooks, thread, rope, or the like which can be received and maintained in the eyelet.

Extending downwardly from the enclosed bottom of the basin means 14 is a drain outlet 86. This drain outlet is adapted to be received in tubing 48 of the first support pad 38. This drain outlet 86 will transport the fluid from the basin means 14 to the holding tank 18.

Figure 3:
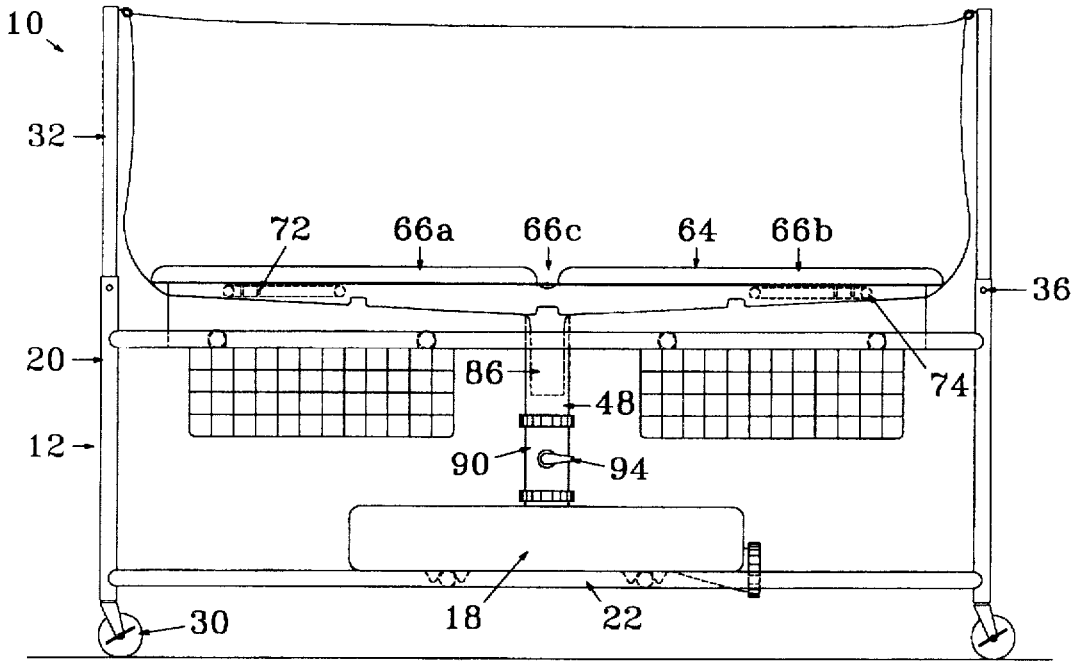
FIG. 3 is a side view of the portable bathing apparatus of the present invention revealing the backrest of the support in a lowered position.
Figure 4:
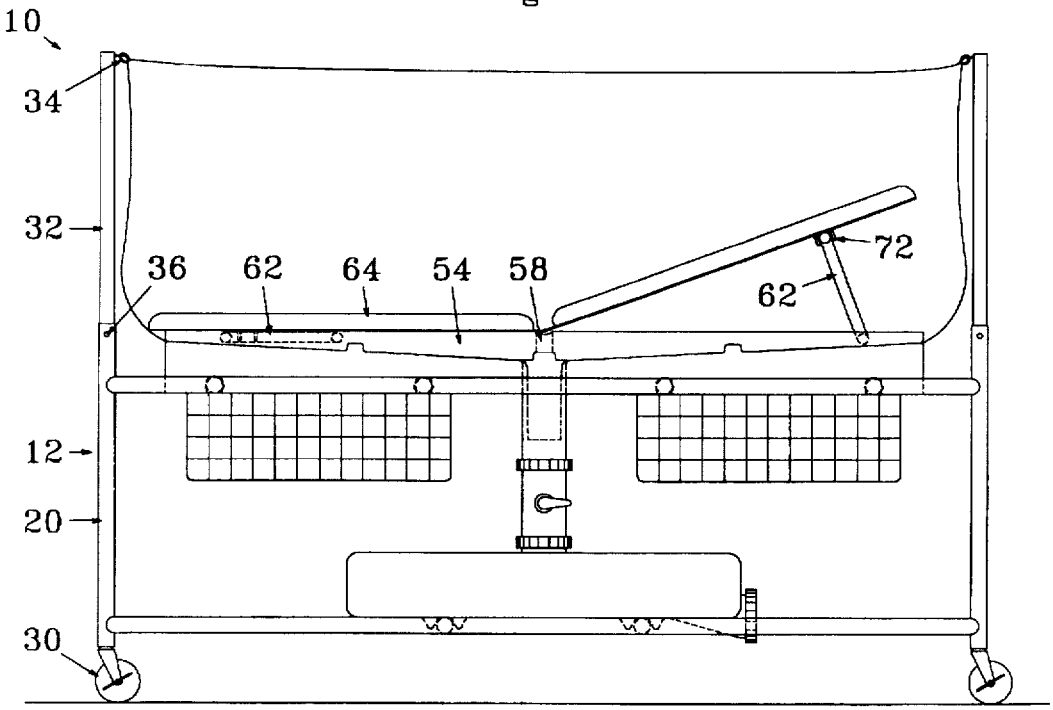
FIG. 4 is a side view of the portable bathing apparatus of the present invention revealing the backrest of the support in a raised position.
Figure 5:
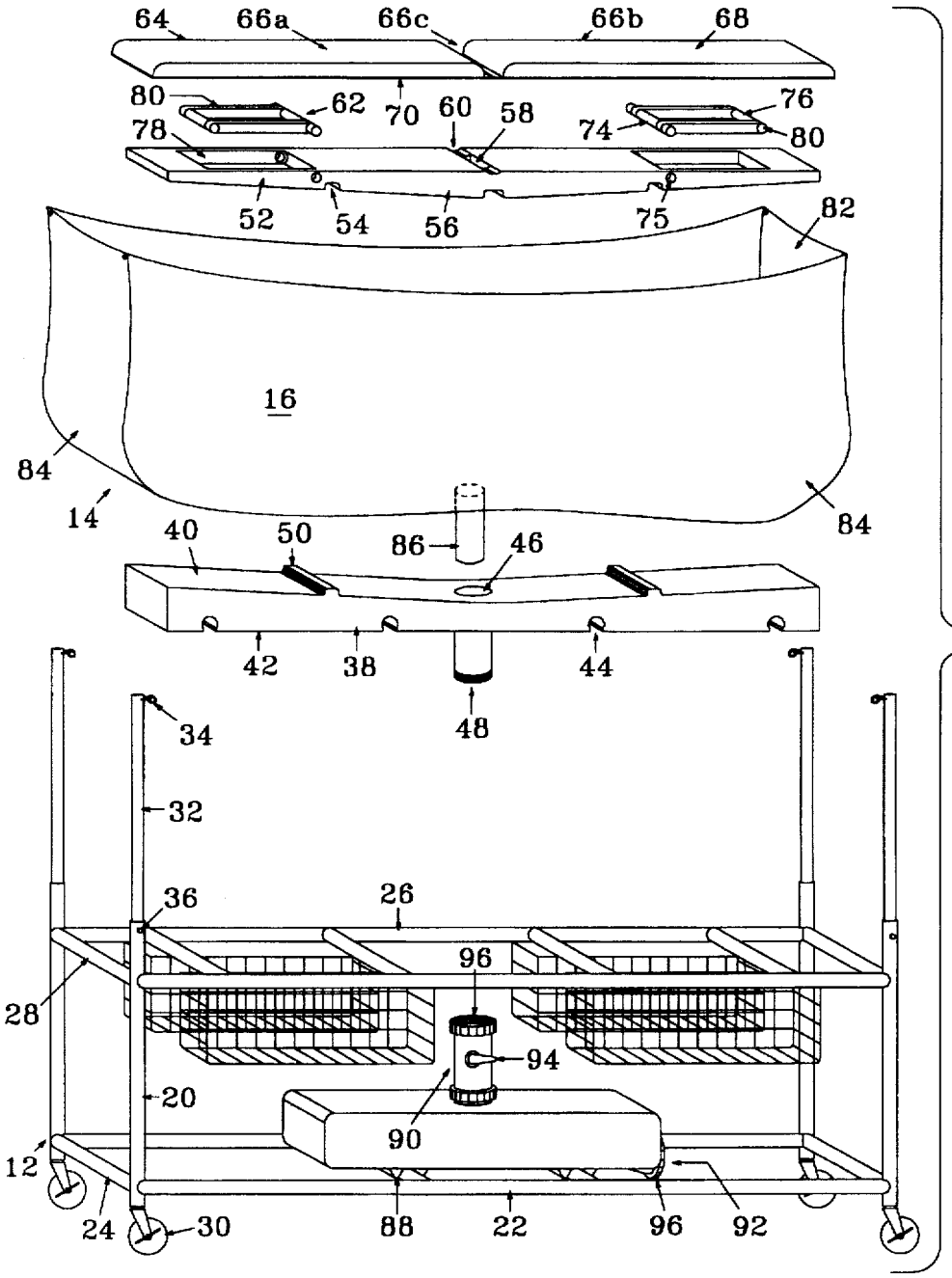
FIG. 5 is a perspective view of the components of the portable bathing apparatus of the present invention prior to assembly.
Figure 6:
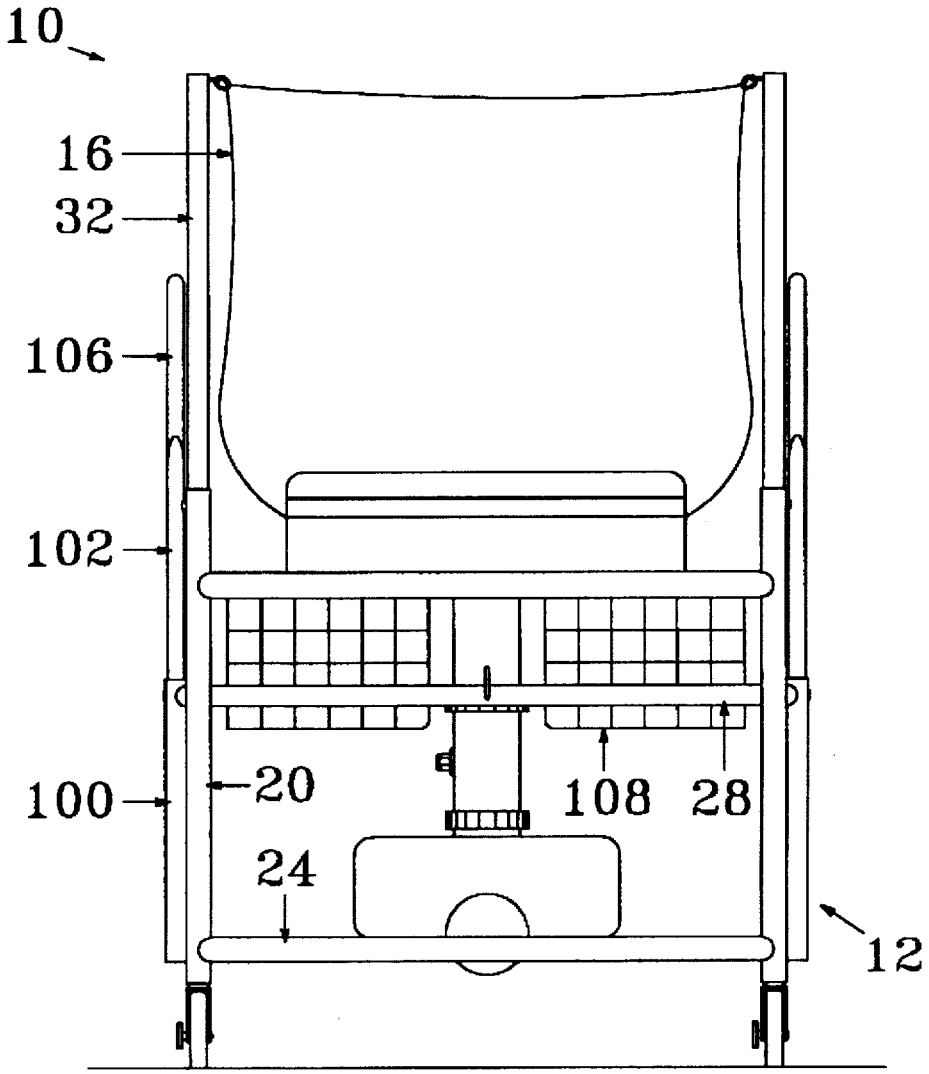
FIG. 6 is a front view of the portable bathing apparatus of the present invention with the safety rails and tub unit raised.

The holding tank 18 is supported on the lower transverse braces 24 of the support frame structure 12. This holding tank can be locked onto these lower transverse braces 24 via braces 88 located on a lower surface of the holding tank 18. Water from the basin means 14 is received within the holding tank via an inlet 90 and exits the holding tank 18 via outlet 92. As illustrated in FIGS. 3, 4, and 5, the drain outlet 86 from the basin means is received in the tubing 48 of the first support pad 38. This tubing 48 is received in the inlet 90 of the of the holding tank. This design and configuration will enable easy removal and transported of the used water in the basin means 14. To avoid leakage from the tubing 48 to inlet 90, the tubing can be secured and locked to the inlet via conventional threading means 96. To enable the water to remain in the basin means and not be transported to the holding tank, the inlet is equipped with a valve 94. This valve 94, when closed, will enable the water to remain within the basin means, or when opened, will provide an open passage for enabling the water to drain.

Figure 7:
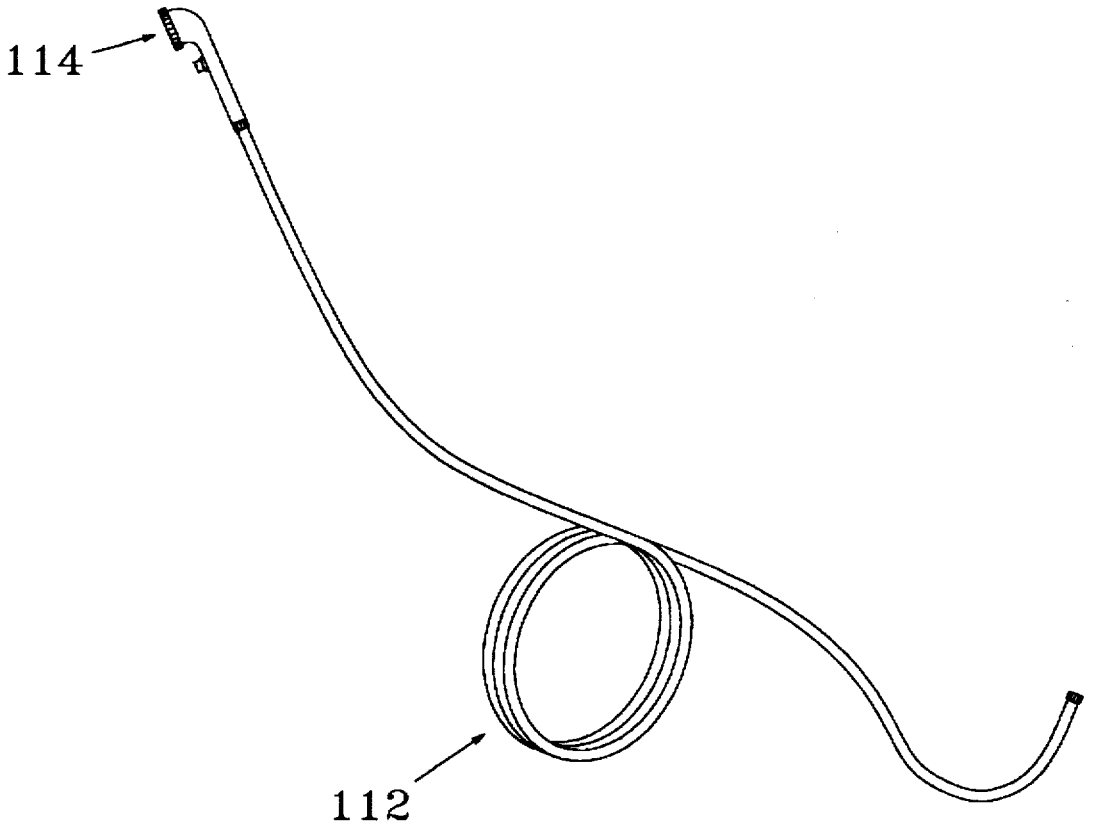
FIG. 7 is a perspective view of a hose which can be used with the bathing apparatus of the present invention.

The outlet 92 is adapted to receive a conventional hose or the like, as illustrated in FIG. 7, for enabling the draining and removal of water from the holding tank 18. The conventional hose 112 can be secured to the outlet 92 via conventional threading means 96. This outlet can be provided with a valve or optionally can be provided with a plug.

Figure 2:
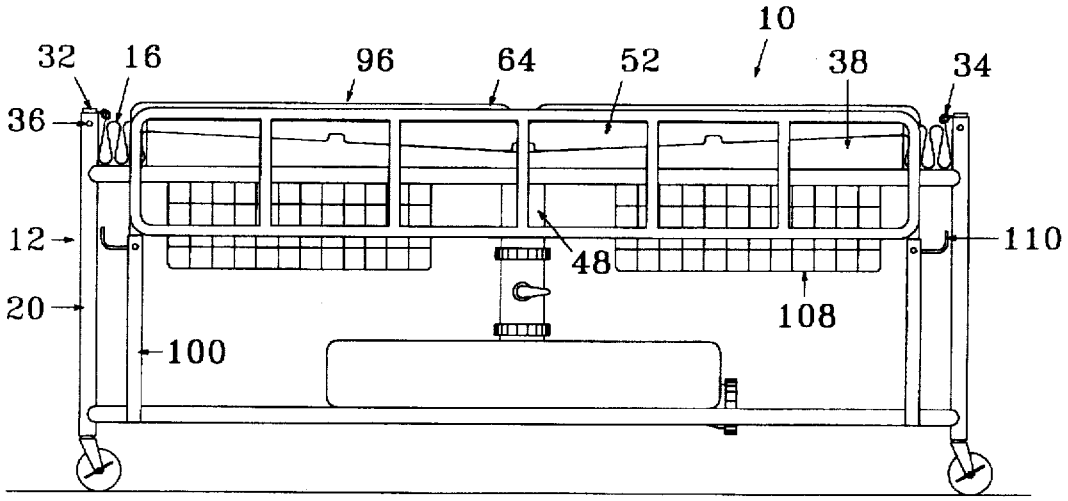
FIG. 2 is a side view of the portable bathing apparatus of the present invention with the safety rails and the tub unit lowered.

For added safety and security, as illustrated in FIGS. 1 and 2, safety rails 106 can be provided. These safety rails include inner vertical frame members 100 extending upwardly from the lower horizontal braces. Received within the upper ends of the inner vertical frame members 100 are inner telescoping members 102. These inner telescoping members 102 are adapted to be raised or lowered within the inner vertical framer members for providing the safety rails to be either in a raised position (FIG. 1) or a lowered position (FIG. 2). The telescoping members 102 are adapted to be in a secured and locked position via a locking means 104.

Extending across the inner telescoping member 102 are horizontal safety rails 106. These horizontal safety rails are used to not only support the side wall of the basin means, but are also used to avoid slippage of the user within the basin area.

Additionally, these inner telescoping members 102 are designed and configured to located below the patient pad 64 when the telescoping members 102 are received within the inner vertical frame members 100 (see FIG. 2). This will render a device which will permit easy access to the patient pad and, accordingly, provides a device wherein personnel are not needed to lift the patient, but rather, the patient can simply slide onto the patient pad. Optionally, conventional means can also be utilized for enabling the patient to slide onto the device. One such means is to provide a sheet or the like under the patient and have approximately two health care workers slide the patient onto the pad via the use of the sheet.

The apparatus 10 of the present invention can also include a plurality of baskets 108 located under the central horizontal braces and central transverse braces or on the upper surface of the lower horizontal braces and lower transverse braces. These baskets 108 will enable items to be maintained therein.

A conventional shower head 114 connected to a hose 112 (illustrated in FIG. 7) can be utilized with the device. This shower head and hose can be stored and maintained in the baskets 108 or optionally on a hook 110.

The apparatus of the present invention is designed and configured to be cleaned and disinfected after each use. Accordingly, the support frame structure can be fabricated from any sturdy, durable, light weight and anti-rust material or coated with an anti-rust substance. Preferably, the frame is constructed from aluminum, stainless steel, polymer or the like.

The first support pad, second support pad, and patient support pad are designed to be removably secured to one another, so as to allow for easy removal and cleaning. The pads, like the frame are fabricated from any sturdy, durable, light weight and anti-rust material, or coated with an anti-rust substance. Preferably, the pads are constructed from any polymeric material.

The collapsible material is designed to be disposable so as to provide for a collapsible material which is to be used once and then discarded. This collapsible material can be fabricated from non-porous, water proof, material, such as latex, rubber, polymer, vinyl, plastic, or the like.

To utilize the present invention, the attendant first lowers all of the telescoping members. Once lowered, the attendant then attaches the collapsible material 16 to the telescoping members 32 via the receiving means 34*a* and 34*b*, respectively. The portable, self-contained bathing apparatus 10 is next positioned along the side of the bed of the patient to be bathed. The wheels 30 are locked into a secured position. The patient can then slide onto the patient support pad 64, or the attendants can lift and place the patient on the patient support pad 64. The first side or second side of the patient support pad can be raised for a back support via the lifting and adjusting means 62. Once secured, the safety rails 106 are raised and locked into place.

The telescoping members 32 are lifted and locked into a fixed position via the locking means 36. The lifting of the telescoping members 32 inherently causes the collapsible material to be lifted and form the basin means. The patient is then able to bathe or otherwise clean themselves in privacy by using the external hand held shower hose and nozzle.

After the showering or bathing operation, the patient is towel dried and returned to their bed. The water is first completely drained. The telescoping member 32 is released and is stored within the vertical frame member 20. The safety rail 106 is lowered. The patient is then returned to his bed. The collapsible material is removed and discarded. Optionally, this, collapsible material can be cleaned and sterilized for furture use. The other components are washed, cleaned and disinfected. The used water within the holding tank is drained. If the collapsible material has been discarded then a new collapsible material is secured to the lowered telescoping members via the receiving means 34*a* and 34*b*. The portable, self-contained bathing apparatus 10 of the present invention is now ready to be relocated to a new location for use by a different patient.

The use of the replaceable collapsible material provides a device which is clean and sterile after each use in order to prevent the occurrence of an unsanitary and unsterile environment.

While the invention has been particularly shown and described with reference to embodiments thereof, it will be understood by those skilled in the art that various changes in form and detail may be made without departing from the spirit and scope of the invention.

We claim:

1. A portable bathtub apparatus comprising:

a support frame structure;

a patient support pad is horizontally secured to said support frame for receiving a patient;

a plurality of telescoping vertical members are secured to said support frame and include means for raising and lowering said plurality of telescoping vertical members between a lowered position generally coplanar with said patient support pad and an upper position above said patient support pad;

a collapsible fluid impermeable material having an enclosed bottom and side walls, said side walls intersecting to form a plurality of comers, each of said plurality of telescoping vertical members being connected to an upper end of a respective one of said comers for forming a basin means when said plurality of telescoping vertical members are in said upper position;

said patient support pad includes a first side and a second side; and a lifting and adjusting means associated with one of said first side and said second side of said patient support pad for enabling said patient support pad to be lifted and adjusted for rendering said patient to be in a comfortable and sitting position.

2. A portable apparatus as in claim 1 wherein said frame structure further includes a plurality of horizontal braces, a water tank storage device is secured to said horizontal braces, and a water drainage means is located between said patient support pad and said water tank storage device for enabling used water to be drained from said basin means.

3. A portable apparatus as in claim 2 wherein said water tank storage device further includes a valve for enabling water to remain in said basin means when said valve is in a closed position or to enable water to flow into said water tank storage device when said valve is in an opened position.

4. A portable apparatus as in claim 3 wherein said water tank storage device includes an outlet having a cover for enabling water to be drained from said water tank storage device once said cover is removed.

5. A portable apparatus as in claim 2 wherein said frame structure further includes a plurality of wheels for mobility.

6. A portable apparatus as in claim 5 wherein said frame structure further includes a plurality of baskets for storage.

7. A portable apparatus as in claim 5 wherein said patient support pad further comprises a first support pad located under said enclosed bottom of said collapsible fluid impermeable material and an upper support pad located above said enclosed bottom of said collapsible fluid impermeable material, and said lifting and adjusting means is located under said upper support pad.

8. A portable apparatus as in claim 2 wherein said collapsible material is removably secured to said plurality of telescoping vertical members via a receiving means.

9. A portable apparatus as in claim 1 wherein said frame structure further includes a plurality of wheels for mobility.

10. A portable apparatus as in claim 1 wherein said frame structure further includes a plurality of baskets for storage.

11. A portable apparatus as in claim 1 wherein said collapsible material is removably secured to said plurality of telescoping vertical members via a receiving means.

12. A portable apparatus as in claim 1 wherein said patient support pad further comprises a first support pad located under said enclosed bottom of said collapsible fluid impermeable material and an upper support pad located above said enclosed bottom of said collapsible fluid impermeable material, and said lifting and adjusting means is located under said upper support pad.

13. A portable apparatus as in claim 12 wherein said first support pad is secured to said upper support pad via an interlocking means.

14. A portable apparatus as in claim 1 wherein said collapsible material includes a drain outlet means.

15. A portable apparatus as in claim 1 wherein a pair of safety rails, horizontally attached to said support frame structure, said safety rails including means for raising and lowering said safety rails between a lower position generally coplanar with said patient support pad and an upper position above said patient support pad.

16. A portable apparatus as in claim 1 further including a hose having a shower head for spraying water from a source into said basin means.

* * * * *